United States Patent [19]

Kimbrough

[11] 4,061,271

[45] Dec. 6, 1977

[54] CONTROL SYSTEM FOR HIGH PRESSURE HYDRAULIC SYSTEM

[76] Inventor: Wade L. Kimbrough, P.O. Box 1467, Hobbs, N. Mex. 88240

[21] Appl. No.: 731,538

[22] Filed: Oct. 13, 1976

[51] Int. Cl.[2] ..... B05B 9/00

[52] U.S. Cl. ..... 239/1; 137/566; 222/318; 251/30; 239/127; 239/126; 417/307

[58] Field of Search ..... 239/124, 127, 126, 1; 222/255, 318; 134/174; 137/563, 566; 251/30, 45; 417/254, 307, 507

[56] References Cited

U.S. PATENT DOCUMENTS

| | | | |
|---|---|---|---|
| 3,147,767 | 9/1964 | Goss | 239/127 X |
| 3,910,497 | 10/1975 | Manor | 239/127 |
| 3,958,724 | 5/1976 | Ordway | 222/318 |

*Primary Examiner*—Evon C. Blunk
*Assistant Examiner*—Michael Mar
*Attorney, Agent, or Firm*—Wendell Coffee

[57] ABSTRACT

In a high pressure liquid system such as those commonly used for cleaning and scaling, a feed pump is connected in series with a high pressure pump. The discharge from the high pressure pump is controlled by a fail-safe pressure responsive valve which is responsive to feed pump pressure.

19 Claims, 2 Drawing Figures

CONTROL SYSTEM FOR HIGH PRESSURE HYDRAULIC SYSTEM

CROSS-REFERENCE TO RELATED APPLICATIONS

None. However, applicant filed Disclosure Document No. 048212 on Mar. 31, 1976, which document concerns this application; therefore by separate paper, it is respectfully requested that the document be retained.

BACKGROUND OF THE INVENTION

1. Field of the Invention.

This invention relates to the control of fluid-spraying devices and more particularly to the control of fluid scaling and cleaning devices having a return to supply from the outlet.

2. Description of the Prior Art.

The discharging from a very high pressure hydraulic system is often employed in cleaning and scaling operations. Fluids under very high pressure are difficult to control and hazardous if not properly controlled.

Before my invention, very high pressure hydraulic systems used in cleaning and scaling operations included the use of a supply reservoir containing liquid, a high pressure pump, a control valve mounted on the outlet of the high pressure pump and a discharge device connected to the control valve. By means of an electric switch mounted on the discharge device, the control valve could be operated to direct the flow of high pressure liquid through the discharge device or to bypass the flow of high pressure liquid back into the supply reservoir.

If the system of electric power to control valve failed, then the system would, in at least some circumstances, continue to discharge liquid under high pressure. This presented a hazard to operation personnel.

Applicant was aware of the following U.S. patents:

| | |
|---|---|
| Goss | 3,147,767<br>239/130 |
| Stasz | 3,380,658<br>239/127 |
| Tuttle | 3,690,558<br>239/127 |
| Manor | 3,910,497 |

SUMMARY OF THE INVENTION

1. New and Different Function.

I have discovered that if two pumps, a feed pump and a high pressure pump, are used to produce the discharge in this type of system then the discharge of the feed pump can be used to operate a pressure responsive valve mounted on the inlet of the bypass conduit. This pressure responsive valve is responsive to the discharge pressure of the feed pump and is connected to the outlet of the feed pump by a conduit containing a normally closed control valve. It is also biased by the discharging of the high pressure pump so that the flow of high pressure liquid is bypassed to the supply reservoir whenever the control valve is closed.

When the control valve is opened, the pressure responsive valve is exposed to the feed pump discharge pressure and is caused to direct the flow of high pressure liquid through the pressure conduit and out the discharge. If an operative is attached to the control valve, it may be operated by a control mounted on the discharge.

Such a system operates much more safely than prior systems. If the source of energy which supplies the operative attached to the control valve fails, the control valve will return to its normally closed position and the feed pump discharge pressure will cause the pressure responsive valve at the entrance to the bypass conduit to direct the flow of high pressure liquid into the supply reservoir.

To return to the safe condition, my system relies only upon the pressure generated by the pressure pump and not upon the forces generated by external power systems or mechanical devices. Also, if the feed pump discharge pressure is weakened, the high pressure works to cut off the discharge.

Thus, a high degree of safety is achieved even though the system is designed to operate at above 10,000psi.

2. Objects of the Invention.

An object of this invention is to control the flow of high pressure liquid.

Another object of this invention is to achieve fail-safe control of the high pressure liquid in a high pressure system by employing a method of control which relies upon system pressure rather than externally created forces to bypass the flow of high pressure liquid into the supply reservoir.

Further objects are to achieve the above with a device that is sturdy, compact, durable, lightweight, simple, safe, efficient, versatile, and reliable, yet inexpensive and easy to manufacture, adjust, operate, and maintain.

Other objects are to achieve the above with a method that is versatile, rapid, efficient, and inexpensive, and does not require skilled people to adjust, operate, and maintain.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Figure 1:
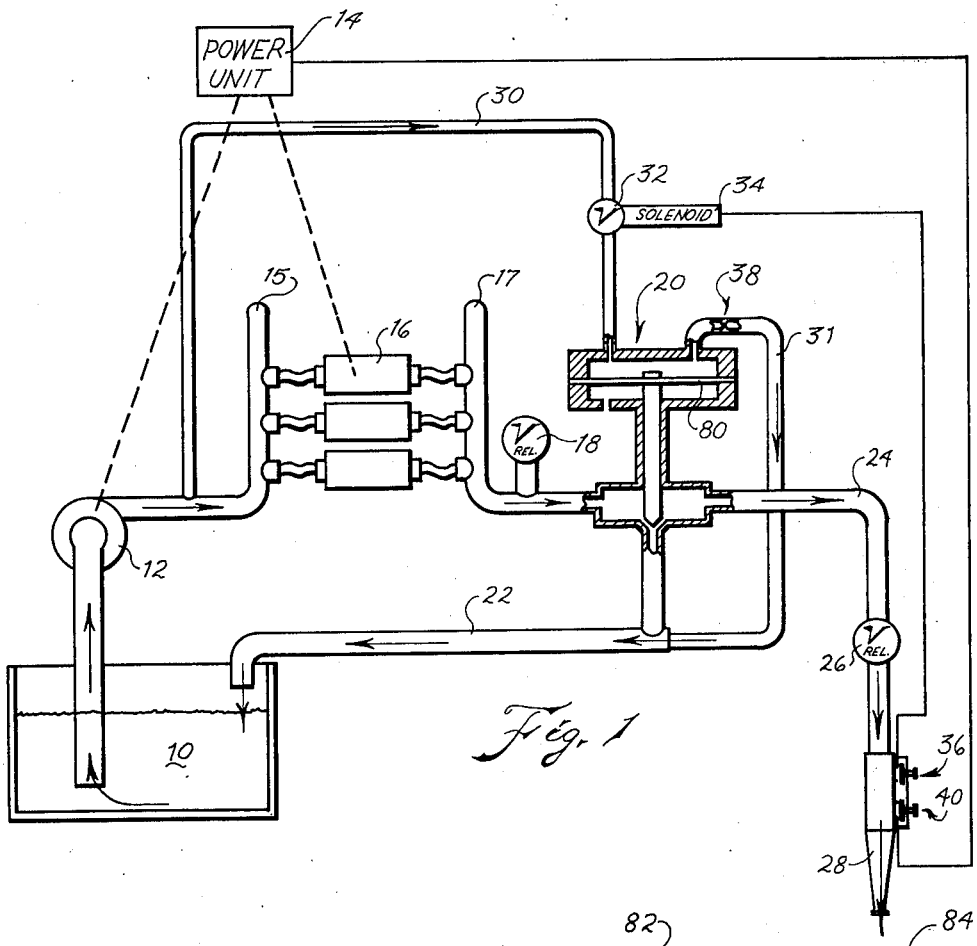
FIG. 1 is a schematic diagram of a system containing the invention.

The liquid (usually wter) used in the system is stored in reservoir 10 which is connected to the inlet of feed pump 12 by a conduit. The feed pump is driven by power unit 14 such as an internal combustion engine. The outlet of the feed pump is connected to pressure inlet 15 of high pressure pump 16. The high pressure pump is also driven by power unit 14 and is capable of producing very high pressures. Pressure outlet 17 of the high pressure pump 16 is connected to pressure responsive valve 20. Relief valve 18 is mounted on the outlet of the high pressure pump as a safety device. The high pressure pump 16 is schematically shown as a triplex positive displacement pump. It will be understood any type pump capable of substantial output at above 10,000psi could be used.

Figure 2:
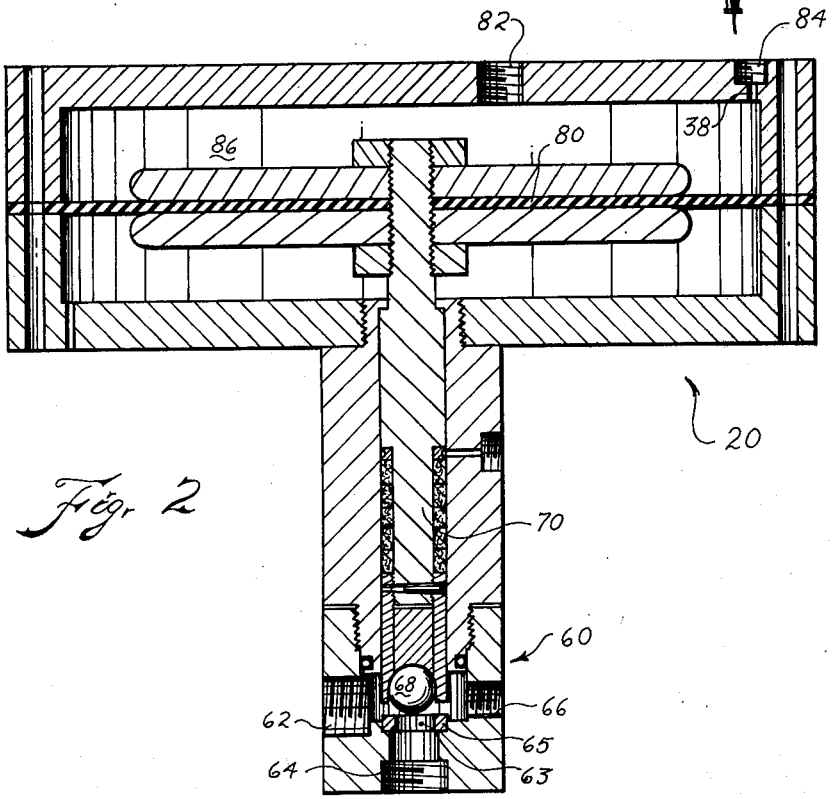
FIG. 2 is a sectional view of the pressure responsive valve.

The liquid enters valve seat body 60 at inlet 62 (FIG. 2). The high pressure liquid exerts a force on valve member 68, a specially hardened sphere, which causes the valve member to move away from valve seat 64. The valve member is attached to valve stem 70 which is thereby forced to move toward pressure responsive device 80, a diaphragm of much larger area than valve stem 70. The pressure responsive device 80 is also connected to the valve stem 70. The valve seat 64 and the valve member sphere 68 are subject to erosion due to the extreme flows resulting from the extreme pressure. The valve tends to have a snap action due to the areas exposed to pressures being reduced when the valve snaps shut as explained later, yet the sphere and seat have severe service environment. Therefore, they are separate units which may be readily replaced.

Conduit 30 connects the feed pump 12 outlet to upper chamber 86. When control valve 32 in conduit 30 is open, a small volume of pressurized liquid travels from the outlet of the feed pump 12 through the control conduit 30 (FIG. 1) and enters the upper chamber 86 of the pressure responsive valve 20 (FIG. 2) at inlet 82. Orifice 38, located in outlet 84, is of such small diameter that pressure created in the upper chamber 86 acts upon the very large surface area of pressure responsive 80 to overcome the force created on the valve stem 70 by the very high pressure liquid in the valve seat body 60. Therefore, the valve member 68 is forced against valve seat 65. High pressure liquid flows around either side the stem 70 and through high pressure outlet 66 of the valve seat body and into high pressure conduit 24. The high pressure liquid is discharged through discharge nozzle 28.

Bleed conduit 31 connects upper chamber outlet 84 and bypass conduit 22, providing a path for the low pressure liquid to return to the reservoir 10.

When control valve 32 is closed, the pressure in the upper chamber 86 drops rapidly. Since the valve stem 70 has a greater surface area than passage area 63 of the valve seat 65, the high pressure liquid will force the valve stem away from the seat. The high pressure liquid will then flow through the valve seat into the bypass conduit 22 and return to the reservoir 10.

When the control valve 32 is open, the pressure in the upper chamber 86 will force the valve member 68 down. The pressure in the valve seat body 60 is low until the member 68 seats on the seat 65. When the member 68 seats, the pressure in the body 60 increases and the area exposed to the high pressure in the body is reduced by the area of the opening 63. I.e., the area exposed to the high pressure is the area of the stem 70 less the area of the opening 63. Thus, the pressure responsive valve 20 may be thought of as at the entrance of the bypass conduit 22.

Since the bypass conduit 22 directly dumps into the reservoir 10, the pressure in the bypass conduit will be very low. However, this same pressure will also be present in the high pressure conduit 24. Therefore, anti-dribble valve 26, here a spring biased ball check valve or pressure relief valve, is placed in the high pressure conduit to prevent the discharge at low pressure liquid through the discharge nozzle 28. Thus, the pressure conduit 24 is closed when the outlet pressure is below a predetermined level.

Safety is assured because control valve 32 is a normally closed valve which can only be opened by solenoid operative 34. Electrical switch 36 is mounted on the discharge nozzle controls the solenoid operative. Discharge of high pressure liquid through the discharge nozzle 28 can only be caused by operation of electrical switch 36. If electrical power is lost, control valve 32 will return to a closed condition and the pressure produced by the high pressure pump 16 acting on valve stem 70 will cause the discharge from the high pressure pump to be bypassed to the reservoir 10.

Electrical switch 40, mounted on discharge nozzle 28, can be operated to stop the power unit 14 in the event of any other malfunction.

Those skilled in the art will understand that the discharge could be a connection rather than the nozzle 28; then, the system used to pressure test vessels and the like rather than for cleaning or scaling.

As an aid to correlating the terms of the claims to the exemplary drawing, the following catalog of elements is provided:

| | |
|---|---|
| 10 reservoir | 36 switch |
| 12 feed pump | 38 orifice |
| 14 power unit | 40 switch |
| 15 pressure inlet | 60 valve |
| 16 pressure pump | 62 valve, inlet |
| 17 pressure outlet | 63 passage area |
| 18 relief valve | 64 bypass outlet |
| 20 P.R. valve | 65 valve, seat |
| 22 bypass conduit | 66 valve, outlet |
| 24 H.P. conduit | 68 valve member |
| 26 A.D. valve | 70 valve stem |
| 28 discharge nozzle | 80 diaphragm |
| 30 conduit | 82 U.C. inlet |
| 31 bleed conduit | 84 U.C. outlet |
| 32 control valve | 86 upper chamber |
| 34 solenoid | |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

SUBJECT MATTER CLAIMED FOR PROTECTION

I claim as my invention:

1. In a liquid system using very high pressures, including a. a high pressure pump having
   i. a pressure inlet, and
   ii. a pressure outlet,
b. a reservoir of liquid,
c. a discharge,
d. a pressure conduit connecting the pressure outlet of the high pressure pump to the discharge, and
e. a control on the discharge;

THE IMPROVED SYSTEM COMPRISING IN COMBINATION:

f. a feed pump having
   i. a feed inlet, and
   ii. a feed outlet,
g. the feed inlet connected to the reservoir of liquid,
h. the feed outlet connected to the pressure inlet,
j. a bypass conduit connecting the pressure outlet to the reservoir,
k. a pressure responsive valve including
   i. a pressure valve at the entrance of the bypass conduit,
   ii. a pressure responsive device for closing said pressure valve, m. the high pressure pump outlet pressure urging the pressure valve located at the entrance to the bypass conduit to an open condition, n. a normally closed control valve interconnecting the pressure responsive device to the feed outlet, o. the pressure responsive device closing the pressure valve when pressurized, and p. said control valve responsive to the control on the discharge.

2. The invention as defined in claim 1 wherein q. said discharge is in the form of a nozzle.

3. The invention as defined in claim 1 with an additional limitation of q. an orifice interconnecting the pressure responsive device to the bypass so that pressure is bled from the pressure responsive device.

4. The invention as defined in claim 1 with additional limitations of q. a solenoid operative connected to said control valve, and r. said control being an electrical switch so that the solenoid is responsive to the switch operation to open the control valve.

5. The invention as defined in claim 1 with an additional limitation of q. a pressure conduit between the pressure valve and the discharge to prevent the liquid from dribbling out the discharge when the pressure valve is open.

6. The invention as defined in claim 1 wherein the pressure valve includes q. a valve seat having i. a pressure side exposed to the high pressure pump outlet and the pressure conduit, ii. a reservoir side exposed to the reservoir, and iii. a passage area, r. a valve member on the pressure side, s. a valve stem at least as large as the passage area connected to a pressure responsive device so that the high pressure pump outlet pressure pushes the valve member away from the seat.

7. The invention as defined in claim 6 wherein t. the valve member is a specially hardened metal sphere, u. the valve member is affixed to the stem, and v. both the valve member and the valve seat are replaceable.

8. The invention as defined in claim 7 wherein w. said discharge is in the form of a nozzle.

9. The invention as defined in claim 8 with an additional limitation of x. an orifice interconnecting the pressure responsive device to the bypass so that pressure is bled from the pressure responsive device.

10. The invention as defined in claim 9 with additional limitations of y. a solenoid operative connected to said control valve, and z. said control being an electrical switch so that the solenoid is responsive to the switch operation to open the control valve.

11. The invention as defined in claim 10 with an additional limitation of aa. a pressure relief valve in the pressure conduit between the pressure valve and the discharge to prevent the liquid from dribbling out the discharge when the pressure valve is open.

12. In a hydraulic system using very high pressures having a. a high pressure pump having i. a pressure inlet and ii. a pressure outlet, b. a reservoir of liquid, c. a discharge, d. a pressure conduit connecting the pressure outlet of the high pressure pump to the discharge, e. a bypass conduit connecting the outlet of the high pressure pump to the reservoir, and f. a pressure valve located at the entrance to the bypass conduit;

THE IMPROVED METHOD OF REGULATING THE FLOW OF HIGH PRESSURE LIQUID COMPRISING IN COMBINATION:

g. feeding the pressure inlet with pressurized liquid, h. operating the pressure valve with a device which is responsive to pressure of the pressure inlet, j. isolating the pressure responsive device from exposure to pressure inlet with a normally closed control valve, k. operating the control valve with a control located on the discharge.

13. The invention as defined in claim 12 with an additional limitation of m. closing the pressure conduit when the outlet pressure is below a predetermined level.

14. The invention as defined in claim 12 with an additional limitation of m. bleeding the pressure responsive device to the bypass.

15. The invention as defined in claim 12 with an additional limitation of m. coupling the pressure responsive device to the pressure valve in such a manner that exposure of the pressure responsive device to inlet pressure results in closing the pressure valve.

16. The invention as defined in claim 12 with an additional limitation of m. biasing the pressure valve to the open condition by acting on the pressure valve with the high pressure outlet pressure.

17. The invention as defined in claim 16 with an additional limitation of o. coupling the pressure responsive device to the pressure valve in such a manner that exposure of the pressure responsive device to inlet pressure results in closing the pressure valve.

18. The invention as defined in claim 17 with an additional limitation of p. bleeding the pressure responsive device to the bypass.

19. The invention as defined in claim 18 with an additional limitation of q. closing the pressure conduit when the outlet pressure is below a predetermined level.

* * * * *